US009102990B2

(12) United States Patent
Smith

(10) Patent No.: US 9,102,990 B2
(45) **Date of Patent: *Aug. 11, 2015**

(54) APPARATUS AND METHOD FOR FRAME AND BRICK CONSTRUCTIONS

(75) Inventor: Todd G. Smith, Harmony, PA (US)

(73) Assignee: Berry Metal Company, Harmony, PA (US)

( * ) Notice: Subject to any disclaimer, the term of this patent is extended or adjusted under 35 U.S.C. 154(b) by 358 days.

This patent is subject to a terminal disclaimer.

(21) Appl. No.: 13/147,929

(22) PCT Filed: Jul. 8, 2010

(86) PCT No.: PCT/US2010/041414

§ 371 (c)(1),
(2), (4) Date: Dec. 23, 2011

(87) PCT Pub. No.: WO2011/005997

PCT Pub. Date: Jan. 13, 2011

(65) Prior Publication Data

US 2012/0104670 A1 May 3, 2012

Related U.S. Application Data

(60) Provisional application No. 61/223,745, filed on Jul. 8, 2009, provisional application No. 61/231,477, filed on Aug. 5, 2009.

(51) Int. Cl.
*C21B 7/06* (2006.01)
*C21B 7/02* (2006.01)
(Continued)

(52) U.S. Cl.
CPC ... *C21B 7/06* (2013.01); *C21B 7/02* (2013.01); *C21C 5/44* (2013.01); *F27B 1/14* (2013.01); *F27D 1/04* (2013.01); *F27D 1/045* (2013.01); *F27D 1/12* (2013.01)

(58) Field of Classification Search
CPC ..... F27D 1/045; F27D 1/12; C21B 7/02
USPC ..... 266/99, 280, 286; 110/343
See application file for complete search history.

(56) References Cited

U.S. PATENT DOCUMENTS 1,921,843 A * 8/1933 Schruefer ..... 52/506.03
3,763,796 A * 10/1973 Venable, Jr. ..... 110/343

(Continued)

OTHER PUBLICATIONS

Form PCT/ISA/220, PCT Notification of Transmittal of the International Search Report and the Written Opinion of the International Search Authority, or the Declaration, PCT/US10/41414, date mailed Sep. 9, 2010.

(Continued)

*Primary Examiner* — Scott Kastler
(74) *Attorney, Agent, or Firm* — Paul D. Bangor, Jr.; Clark Hill, PLC

(57) ABSTRACT

A frame/brick and/or a stave/brick construction, having a frame having a plurality of ribs and a plurality of channels, wherein a front face of the frame defines a first opening into each of the channels, and a plurality of bricks wherein each brick is insertable into one of the plurality of channels via its first opening to a position, upon rotation of the brick, partially disposed in the one channel such that one or more portions of the brick at least partially engage one or more surfaces of the one channel and/or of a first rib of the plurality of ribs whereby the brick is locked against removal from the one channel through its first opening via linear movement without first being rotated.

55 Claims, 4 Drawing Sheets

(51) Int. Cl.

| | |
|---|---|
| ***C21C 5/44*** | (2006.01) |
| ***F27B 1/14*** | (2006.01) |
| ***F27D 1/04*** | (2006.01) |
| ***F27D 1/12*** | (2006.01) |

(56) References Cited

U.S. PATENT DOCUMENTS

| | | | | |
|---|---|---|---|---|
| 5,117,604 | A * | 6/1992 | Bly et al. | 52/509 |
| 6,363,868 | B1 * | 4/2002 | Boswell et al. | 110/213 |
| 2009/0126306 | A1 * | 5/2009 | Jonville et al. | 52/506.02 |
| 2012/0104670 | A1 * | 5/2012 | Smith | 266/280 |
| 2013/0181384 | A1 * | 7/2013 | Smith et al. | 266/99 |

OTHER PUBLICATIONS

Form PCT/ISA/210, PCT International Search Report for International Application No. PCT/US2010/041414, date mailed Sep. 9, 2010.

Form PCT/ISA/237, PCT Written Opinion of the International Searching Authority for International Application No. PCT/US2010/041414, date mailed Sep. 9, 2010.

Form PCT/IPEA/416, PCT Notification of Transmittal of the Int'l Preliminary Report on Patentability for Int'l Appln No. PCT/US2010/41414, date mailed Jun. 21, 2011.

Form PCT/IPEA/409, PCT International Preliminary Report on Patentability for Int'l Appln No. PCT/US2010/41414, date mailed Jun. 21, 2011.

* cited by examiner

APPARATUS AND METHOD FOR FRAME AND BRICK CONSTRUCTIONS

CROSS REFERENCE TO RELATED APPLICATIONS

This application claims the benefit of (1) provisional patent application U.S. Ser. No. 61/223,745 filed Jul. 8, 2009, by the present inventor, which is incorporated by reference herein and (2) provisional patent application U.S. Ser. No. 61/231,477 filed Aug. 5, 2009, by the present inventor, which is incorporated by reference herein.

TECHNICAL FIELD OF THE INVENTION

This invention relates generally to apparatus and methods for constructing and installing bricks, such as refractory bricks, in frames, staves and/or coolers in blast furnaces or other metallurgical furnaces. Related fields include systems and methods for cooling blast furnaces and other metallurgical furnaces. Related fields include cooling plates and cooling staves.

BACKGROUND

Field of the Disclosure

Conventional designs and constructions for cooling refractory bricks in blast furnaces and other metallurgical furnaces include cooling staves. Conventional copper cooling staves are generally planar, rectangularly shaped and arranged within a furnace substantially parallel or as parallel as possible, given the shapes of the staves and/or the interior of the furnace, to the metal shell of the furnace. The cooling staves typically cover a high percentage of the inner surface of the metal shell of the furnace. Refractory lining, such as refractory bricks, may be disposed in, on or around the surface of the stave, such as, for example, bricks disposed within slots or channels defined by the stave. Staves also have cavities that provide passages or house internal piping. Such passages or piping are connected to one or more external pipes that extend from the furnace shell side of the stave and penetrate the metal shell of the furnace. Coolant, such as, for example, water at an elevated pressure is pumped through the pipes and passages in order to cool the stave. The cooled stave thus cools the refractory bricks disposed within slots or channels defined by the stave.

Current stave or cooling panel brick designs typically are installed in grooves or channels in the cooler before installing the cooling stave/panel in the furnace. Further, many conventional refractory bricks are designed to be installed in a flat stave or cooler. When using flat or curved staves/coolers with pre-installed bricks, the staves are installed in the furnace and have a ram gap in between each pair of adjacent staves to allow for construction deviation. These ram gaps are then filled with refractory material to close the gap between the stave/brick constructions on the sides of the gap. This refractory filled ram gap typically is a weak point in a furnace lining comprising conventional stave/brick constructions. During furnace operation, the ram gap often erodes prematurely and furnace gases track between the staves. Moreover, such conventional stave/brick constructions leave brick edges protruding into the furnace which are exposed to matter and other debris falling through the furnace. Such protruding brick edges tend to wear out more frequently than non-protruding edges, leading to broken or crumbled bricks that may fall through the furnace causing further damage to the furnace lining. Such broken bricks also expose the stave thereby causing it to be damaged or worn out prematurely.

Current stave or cooling panel bricks are typically either installed in straight grooves employed as the main method of attachment to keep the bricks in the cooler or tapered to force bricks which are not locked in grooves in the stave to push against the cooler when the bricks are heated during furnace operation.

Also, in recent years, it has been a common practice to install staves without refractory in front of them and try to form a skull layer to protect and insulate the stave in a blast furnace. This process related skull is generated and lost repeatedly in service and actually changes furnace performance. Skulls can only be formed in the cohesive zones of the furnace. Therefore, this skull approach is not effective if the cohesive zone is incorrectly determined. Additionally, the cohesive zone of the furnace changes depending on charge material and the skull adhesion is lost in sections of the furnace at different times. This results in non-uniform temperatures throughout the staves and furnace. However, an improved brick refractory lining protects the stave regardless of adhesion and would be preferable to such skull insulating process, even through in some cases it may still be desirable to form the skull to protect the improved refractory.

Current locked-in brick designs, such as dovetailed bricks in complementary-shaped stave channels, are relatively thin throughout their vertical thickness. Such thin-necked bricks are susceptible to cracking at the thin neck portion thereby creating brick fragments and pieces falling into the furnace which may hit and damage other bricks and staves of the furnace lining.

Many older stave designs which incorporate bricks in front of the stave employ multiple rows or layers of bricks in front of the stave. Such constructions contain joints which further prevent effective cooling of the bricks farthest from the stave.

As listed above, many shortcomings are associated with known stave and refractory brick constructions.

Accordingly, it would be desirable to provide a stave/brick construction in which the refractory bricks may be installed in a flat or curved stave or cooler, before or after the stave cooler is installed in a furnace. Additionally, in the event of a reworking or rebuilding of the stave/brick construction in the furnace, the refractory bricks of the present invention can be replaced or re-installed in-whole or in-part, without removing the stave or cooler from the furnace.

In addition, it would be desirable to provide a stave/brick construction which provides a continuous lining around the interior circumference of the furnace that eliminates ram gaps between the bricks of adjacent staves and thereby increases the integrity and life of the furnace lining.

Further, it would be desirable to provide a stave/brick construction ideal for use in blast furnaces in which no brick edges are exposed or protrude into the furnace to increase the life and integrity of the furnace lining.

In addition, it would be desirable to provide a stave/refractory brick construction in which the refractory bricks can be installed in a stave or cooler that is tilted on an angle with the bricks staying in the grooves in such stave or cooler and in which the bricks may be inserted and/or removed from the front face of the stave before and/or after the stave is installed in the furnace.

Furthermore, it would be desirable to provide a stave/refractory brick construction in which the refractory bricks are doubly locked into the channels in the stave (1) by complementary surfaces of the bricks and stave channels that are engaged by inserting a portion of each brick into a channel or groove in the stave and simultaneously or thereafter rotating each brick on an axis substantially parallel to a plane of the stave and/or (b) such that the bottom of the brick rotates in a direction towards or substantively towards the stave in order to engage such complementary surfaces of the channel and brick in order to secure or lock the brick into the channel chamber and prevent it from moving linearly out of the channel or groove through an opening in the front face of the stave and (2) by oblique or tapered sections of the bricks that expand when heated during furnace operation, and push against the stave or cooler to maintain an effective bond therewith thereby providing highly effective cooling of the bricks, while also holding in place any bricks that might crack or break.

Moreover, it would be desirable to provide a stave/refractory brick construction in which the stave surface temperature is uniform and which allows for more consistent furnace operation with less loss of heat to thereby reduce stresses on the furnace and staves and increase the life of both.

Further yet, it would be desirable to provide a stave/refractory brick construction utilizing bricks having an increased vertical or neck thickness to increase strength and make the bricks less susceptible to cracking while also allowing the bricks to be installed faster, with the additional weight of each brick helping to keep it in place and less susceptible to failure.

Additionally, it would be desirable to provide an improved stave/refractory brick construction having a single layer of bricks in tight contact with the stave to eliminate thermal barriers associated with conventional stave/brick constructions having multiple layers and/or multiple mortar joints.

Further still, it would be desirable to provide an improved stave/refractory brick construction in which the refractory bricks are made of differing shapes and/or materials depending upon the type of furnace and/or the installation location within the furnace.

In addition, it would be desirable to provide an improved frame/brick construction for any application where it would be advantageous to be able to (1) brick, re-brick and/or repair the frame/brick construction after the frame has been installed and/or (2) to employ the double brick locking features of the present invention for elevated temperature applications.

These and other advantages of the invention will be appreciated by reference to the detailed description of the preferred embodiment(s) that follow.

BRIEF SUMMARY OF THE INVENTION

In a first aspect, the present invention comprises a stave/brick construction, comprising: a stave having a plurality of ribs and a plurality of channels, wherein a front face of the stave defines a first opening into each of the channels; and a plurality of bricks wherein each brick is insertable into one of the plurality of channels via its first opening to a position, upon rotation of the brick, partially disposed in the one channel such that one or more portions of the brick at least partially engage one or more surfaces of the one channel and/or of a first rib of the plurality of ribs whereby the brick is locked against removal from the one channel through its first opening via linear movement without first being rotated. Preferably, the stave may define one or more side openings into each of the channels. Also, the one or more portions of the brick comprises a nose at least partially disposed in a first section of the one channel, which is preferably complementary to the nose. In addition, rotation of the brick comprises a bottom of the brick moving in a direction towards the stave.

In accordance with yet another aspect of the stave/brick construction, a first rib surface of the first rib preferably is complementary to a groove defined by a top of the brick and the first rib surface is at least partially disposed in the groove.

In accordance with yet a further aspect of the stave/brick construction, each of the plurality of bricks can be removed from its respective channel via rotation of each brick comprising a bottom of each brick moving in a direction away from the stave.

In yet a further aspect of the stave/brick construction, the stave is preferably either substantially flat or curved with respect to one or both of a horizontal axis and a vertical axis of the stave.

In yet an additional aspect of the stave/brick construction, the stave houses a plurality of pipes.

In yet a further aspect of the stave/brick construction, preferably the plurality of bricks at least partially disposed in the plurality of channels form a plurality of stacked, substantially horizontal rows of bricks protruding from the front face of the stave, where the plurality of bricks comprise exposed faces that preferably define a flat surface or uneven surface.

In accordance with yet a further aspect of the stave/brick construction, one of the bricks cannot be pulled and/or rotated out of the first opening of its respective channel when another brick is disposed in the row above and partially or completely covers the one brick.

In accordance with yet another aspect of the present invention, the stave/brick construction comprises a plurality of staves standing side-by-side with gaps between adjacent staves; wherein each stave has a plurality of ribs, a plurality of channels, and a plurality of substantially horizontal rows of bricks disposed in the plurality of channels. Preferably, the plurality of substantially horizontal rows of bricks disposed in the plurality of channels covers, in-whole or in-part, the gaps between adjacent staves. Also, the staves stand substantially vertically or at an angle other than about 90 degrees.

In yet a further aspect of the stave/brick construction, each of the plurality of bricks further defines a seat wherein the seat is at least partially disposed in a second section of the one channel and preferably the second section is complementary to the seat.

In yet an additional aspect of the stave/brick construction, each of the plurality of bricks comprises an oblique top section and an oblique bottom section, wherein each of the oblique top and bottom sections protrude from the face of the stave and preferably the oblique top and bottom sections of each brick are substantially parallel to each other.

In accordance with yet another aspect of the stave/brick construction of the present invention, the plurality of bricks at least partially disposed in the plurality of channels form a plurality of stacked, substantially horizontal rows of bricks protruding from the front face of the stave; and wherein the oblique top section of one brick is disposed substantially near, adjacent to, in partial contact with or in complete contact with the oblique bottom section of another brick immediately above the one brick.

In yet an additional aspect, the stave/brick construction of the present invention further comprises means for operatively connecting a thermocouple to the stave.

In another aspect, the present invention comprises a frame/brick construction, comprising: a frame having a plurality of ribs and a plurality of channels, wherein a front face of the frame defines a first opening into each of the channels; and a plurality of bricks wherein each brick is insertable into one of the plurality of channels via its first opening to a position, upon rotation of the brick, partially disposed in the one channel such that one or more portions of the brick at least partially engage one or more surfaces of the one channel and/or of a first rib of the plurality of ribs whereby the brick is locked against removal from the one channel through its first opening via linear movement without first being rotated. Preferably, the frame may define one or more side openings into each of the channels. Also, the one or more portions of the brick comprises a nose at least partially disposed in a first section of the one channel, which is preferably complementary to the nose. In addition, rotation of the brick comprises a bottom of the brick moving in a direction towards the frame.

In accordance with yet another aspect of the frame/brick construction, a first rib surface of the first rib preferably is complementary to a groove defined by a top of the brick and the first rib surface is at least partially disposed in the groove.

In accordance with yet a further aspect of the frame/brick construction, each of the plurality of bricks can be removed from its respective channel via rotation of each brick comprising a bottom of each brick moving in a direction away from the frame.

In yet a further aspect of the frame/brick construction, the frame is preferably either substantially flat or curved with respect to one or both of a horizontal axis and a vertical axis of the frame.

In yet a further aspect of the frame/brick construction, preferably the plurality of bricks at least partially disposed in the plurality of channels form a plurality of stacked, substantially horizontal rows of bricks protruding from the front face of the frame, where the plurality of bricks comprise exposed faces that preferably define a flat surface or uneven surface.

In accordance with yet a further aspect of the frame/brick construction, one of the bricks cannot be pulled and/or rotated out of the first opening of its respective channel when another brick is disposed in the row above and partially or completely covers the one brick.

In accordance with yet another aspect of the present invention, the frame/brick construction comprises a plurality of frames standing side-by-side with gaps between adjacent frames; wherein each frame has a plurality of ribs, a plurality of channels, and a plurality of substantially horizontal rows of bricks disposed in the plurality of channels. Preferably, the plurality of substantially horizontal rows of bricks disposed in the plurality of channels covers, in-whole or in-part, the gaps between adjacent frames. Also, the frames stand substantially vertically or at an angle other than about 90 degrees.

In yet a further aspect of the frame/brick construction, each of the plurality of bricks further defines a seat wherein the seat is at least partially disposed in a second section of the one channel and preferably the second section is complementary to the seat.

In yet an additional aspect of the frame/brick construction, each of the plurality of bricks comprises an oblique top section and an oblique bottom section, wherein each of the oblique top and bottom sections protrude from the face of the frame and preferably the oblique top and bottom sections of each brick are substantially parallel to each other.

In accordance with yet another aspect of the frame/brick construction of the present invention, the plurality of bricks at least partially disposed in the plurality of channels form a plurality of stacked, substantially horizontal rows of bricks protruding from the front face of the frame; and wherein the oblique top section of one brick is disposed substantially near, adjacent to, in partial contact with or in complete contact with the oblique bottom section of another brick immediately above the one brick.

In yet another aspect, the present invention comprises a method for assembling a stave/brick construction comprising: providing a stave in a standing position, wherein the stave has a plurality of ribs and a plurality of channels, wherein a front face of the stave defines a first opening into each of the channels; and inserting a plurality of bricks into each channel via its first opening so that a first portion of each brick enters its respective channel via its first opening; and rotating each brick so that it is partially disposed in its respective channel with its first portion at least partially engaged with one or more surfaces of its respective channel and/or of a first rib of the plurality of stave ribs whereby the brick is locked against linear movement out of the one channel through its first opening. Preferably, after inserting, the first portion of each brick is at least partially disposed in a first section of its respective channel, and the rotating of each brick comprises a bottom of the brick moving in a direction towards the stave.

In accordance with yet another aspect, the method for assembling a stave/brick construction of the present invention further comprises: removing one or more of the plurality of bricks from their respective channels via rotation of the one or more bricks comprising a bottom of each brick moving in a direction away from the stave.

In yet another aspect, the present invention comprises a brick for a stave/brick construction, comprising: a top section defining a nose contiguous with a locking side of the brick and an upper oblique section contiguous with a first face of the brick, wherein the locking side comprises the nose, a second face, a seat and a lower concave section; and a bottom defining a lower oblique section contiguous with the first face of the brick. Preferably, brick may further comprise a groove defined by the top section disposed across a width of the brick.

In accordance with yet another aspect, the brick for a stave/brick construction of the present invention, the second face extends from the nose to the seat and is opposite to the first face. Also, preferably, a height of the second face is equal to or greater than about two times a depth of the brick measured from the second face to a bottom of the groove.

In accordance with yet a further aspect of the brick for a stave/brick construction of the present invention, preferably one or both of the nose and seat may be arcuate, polygonal or angular. Also, one or both of the first and second faces of the brick preferably are substantially flat.

In yet another aspect, the present invention comprises a stave/brick construction, comprising: a stave having a plurality of ribs and a plurality of channels, wherein a front face of the stave defines a first opening into each of the channels and wherein the plurality of ribs comprises one or more short ribs each of which is shorter than one or more adjacent long ribs, wherein each short rib and at least one adjacent long rib define, at least in part, a void such that the stave defines a plurality of voids; and a plurality of bricks wherein each brick is insertable into one of the plurality of voids in a direction substantially perpendicular to the front face to a first position from which it can be slid to a second position within one of the plurality of channels Many other variations are possible with the present invention, and those and other teachings, variations, and advantages of the present invention will become apparent from the description and figures of the invention.

BRIEF DESCRIPTION OF THE SEVERAL VIEWS OF THE DRAWINGS

For the present disclosure to be easily understood and readily practiced, the present disclosure will now be described for purposes of illustration and not limitation in connection with the following figures, wherein.

DETAILED DESCRIPTION OF PREFERRED EMBODIMENT(S) OF THE INVENTION

In the following detailed description, reference is made to the accompanying examples and figures that form a part hereof, and in which is shown, by way of illustration, specific embodiments in which the inventive subject matter may be practiced. These embodiments are described in sufficient detail to enable those skilled in the art to practice them, and it is to be understood that other embodiments may be utilized and that structural or logical changes may be made without departing from the scope of the inventive subject matter. Such embodiments of the inventive subject matter may be referred to, individually and/or collectively, herein by the term "invention" merely for convenience and without intending to voluntarily limit the scope of this application to any single invention or inventive concept if more than one is in fact disclosed.

The following description is, therefore, not to be taken in a limited sense, and the scope of the inventive subject matter is defined by the appended claims and their equivalents.

Figure 1:
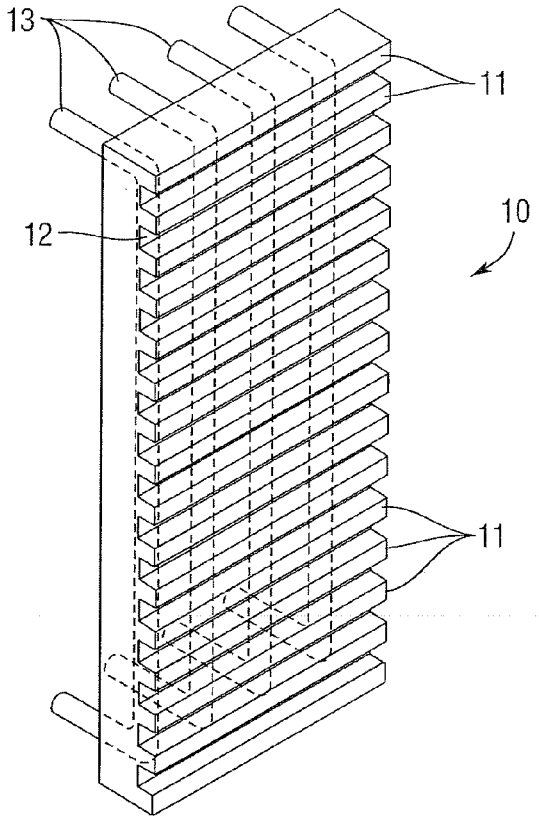
Prior Art Fig.1
FIG. 1 is a front perspective view of a conventional stave.

FIG. 1 illustrates a planar, fluid cooled stave 10 of known construction having a plurality of stave ribs 11 and defining a plurality of stave channels 12, both of generally rectangular cross-sections for use with bricks having matching cross-sections. Other stave designs of known construction (not shown) employ stave ribs and stave channels having cross-sections complementary to the dovetail sections 16 of the conventional refractory brick 14 shown in FIG. 2 to allow such dovetailed sections 16 thereof to be inserted into the side ends of the stave and slid into position therein with or without mortar in between each adjacent brick. A major disadvantage of such known stave/brick constructions is that due to the closeness to each other when installed in a furnace, such staves 10 must be removed from the furnace to allow the bricks 14 to be slid out of the stave channels 12 whenever the stave/brick construction needs to be rebuilt or repaired, either in-whole or in-part. Removing such staves 10 from the furnace is necessitated because bricks 14 cannot be removed or inserted into stave channels 12 through the front face of stave 10. As shown in FIG. 1, stave 10 comprises a plurality of pipes 13 disposed inside the stave 10 which may be connected to one or more external pipes that extend from the furnace shell side of the stave 10 and penetrate the metal shell of the furnace so that coolant, such as, for example, water at an elevated pressure is pumped through the pipes 13 in order to cool the stave 10 and any refractory bricks disposed within stave channels 12 when assembled and installed in a furnace.

Figure 2:
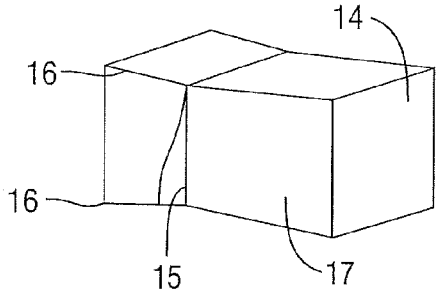
Prior Art Fig.2
FIG. 2 is a side perspective view of a conventional, dovetailed refractory brick.

As further illustrated in FIG. 2, conventional dovetailed refractory brick 14 has a relatively thin vertical neck 15 which is susceptible to breakage in the furnace environment, particularly where the length of protruding portion 17 of brick 14 which protrudes into the furnace from stave 10 is long relative to the overall depth or length of brick 14.

Figure 3:
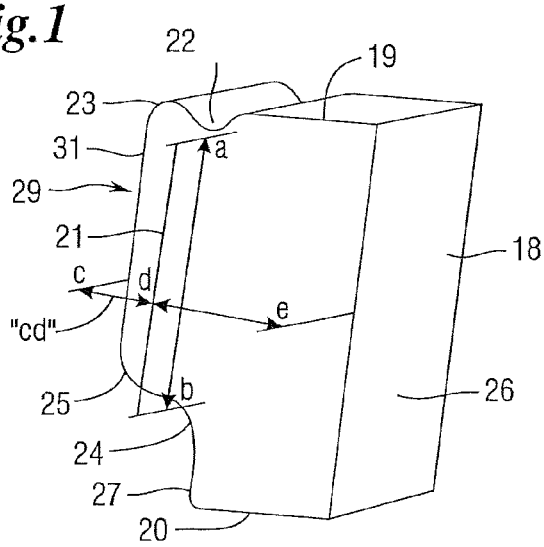
FIG. 3 is a side perspective view of a brick according to a preferred embodiment of the present invention.
Figure 4:
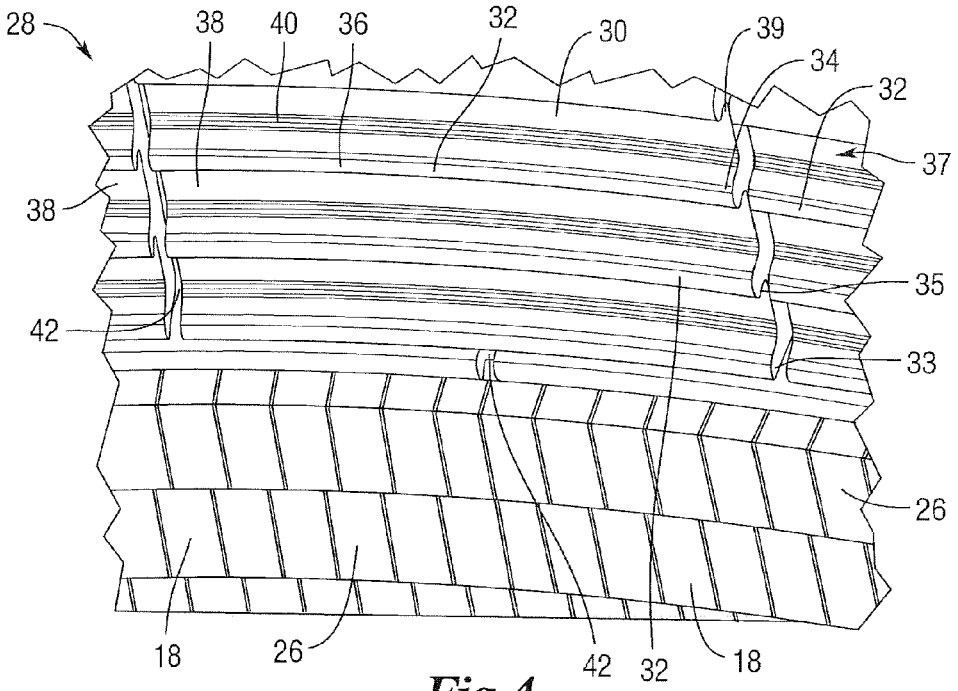
FIG. 4 is a top perspective view of a preferred embodiment of a furnace lining of the present invention comprising a preferred embodiment of a stave/brick construction of the present invention employing the brick of FIG. 3.

FIG. 3 illustrates a preferred embodiment of a refractory brick 18 according to a preferred embodiment of a stave/brick construction 28 of the present invention. Brick 18 has an exposed face 26 and oblique or slanted top and bottom sections 19 and 20, respectively. Brick 18 also comprises or defines a locking side 29 comprising concave groove 22, a generally arcuate nose 23, a generally arcuate seat 25, a generally arcuate concave section 24, a lower face 27 and a generally planar front face 31. Brick 18 also has a neck 21, the vertical thickness ("ab") of which is increased with respect to the vertical neck 15 of known bricks 14. Preferably, the length "ab" of vertical neck 21 is equal to or greater than about two (2) times the length "cd" of the depth of brick 18 that is disposed in stave channel 37 when the brick 18 is installed therein. The shapes, geometries and/or cross-sections of brick 18 and/or any part thereof, including, without limitation, one or more of exposed face 26, lower face 27, front face 31, oblique/slanted top section 19, oblique/slanted bottom section 20, groove 22, nose 23, seat 25, concave section 24 and front locking side 29 may be modified or take other forms such as being angular, rectilinear, polygonal, geared, toothed, symmetrical, asymmetrical or irregular instead the shapes of the preferred embodiments thereof as shown in the drawings hereof without departing from the scope of the invention hereof. The refractory bricks 18 of the present invention preferably may be constructed from many of the refractory materials currently available including, but not limited to, silicon carbide (such as Sicanit AL3 available from Saint-Gobain Ceramics), MgO—C (magnesia carbon), alumina, insulating fire brick (IFB), graphite refractory brick and carbon. In addition, bricks 18 may be constructed from alternating or different materials depending upon their location in a stave 30 or within the furnace. Also, as set forth above, the shape of bricks 18 may also be modified or altered to meet various stave and/or furnace spaces and/or geometries.

Preferred embodiments of a stave/refractory brick construction 28 of the present invention is shown in FIGS. 3-8 and 10, including a preferred embodiment of a stave 30 of the present invention. Stave 30 may comprise a plurality of pipes (not shown), such as the pipes 13 disposed inside the stave 10 as shown in FIG. 1, which may be attached to one or more external pipes that extend from the furnace shell side of the stave 30 and penetrate the metal shell of the furnace so that coolant, such as, for example, water at an elevated pressure is pumped through such pipes (not shown) in order to cool the stave 30 and any refractory bricks 18 disposed within stave channels 37 thereof when assembled and installed in a furnace. Preferably, the stave 30 is constructed of copper, cast iron or other metal of high thermal conductivity, while any pipes disposed with stave 30 are preferably made from steel.

Each stave 30 preferably may be curved about its horizontal axis and/or about its vertical axis to match the internal profile of the furnace or area in which they will be used. Each stave 30 preferably comprises a plurality of stave ribs 32 and a stave socle 33 to support stave 30 in a standing position which may be a fully upright 90 degrees as shown, or a tilted or slanted position (not shown). Each stave rib 32 preferably defines a generally arcuate top rib section 34 and a generally arcuate bottom rib section 35. Stave 30 preferably defines a plurality stave channels 37 between each successive pair of stave ribs 32. Preferably, each stave channel 37 is generally "C-shaped" or "U-shaped" and includes a generally planar stave channel wall 38, although stave channel wall 38 may also be curved or contoured along its vertical and/or horizontal axes, toothed, etc., to be complementary with the front face 31 of brick 18 if such front face 31 has a shape other than the planar shape depicted herein, which may depend upon the application. Each stave channel 37 also preferably includes a generally arcuate upper channel section 39 and a generally arcuate lower channel section 40, all as defined by stave 30 and a successive pair of stave ribs 32. The shapes, geometries and/or cross-sections of one or more of the stave ribs 32, top rib sections 34, bottom rib sections 35, stave channels 37, stave channel walls 38, upper channel sections 39 and lower channel sections 40, preferably may be modified or take other forms such as being contoured, angular, rectilinear, polygonal, geared, toothed, symmetrical, asymmetrical or irregular instead the shapes of the preferred embodiments thereof as shown in the drawings hereof without departing from the scope of the invention hereof.

Figure 5:
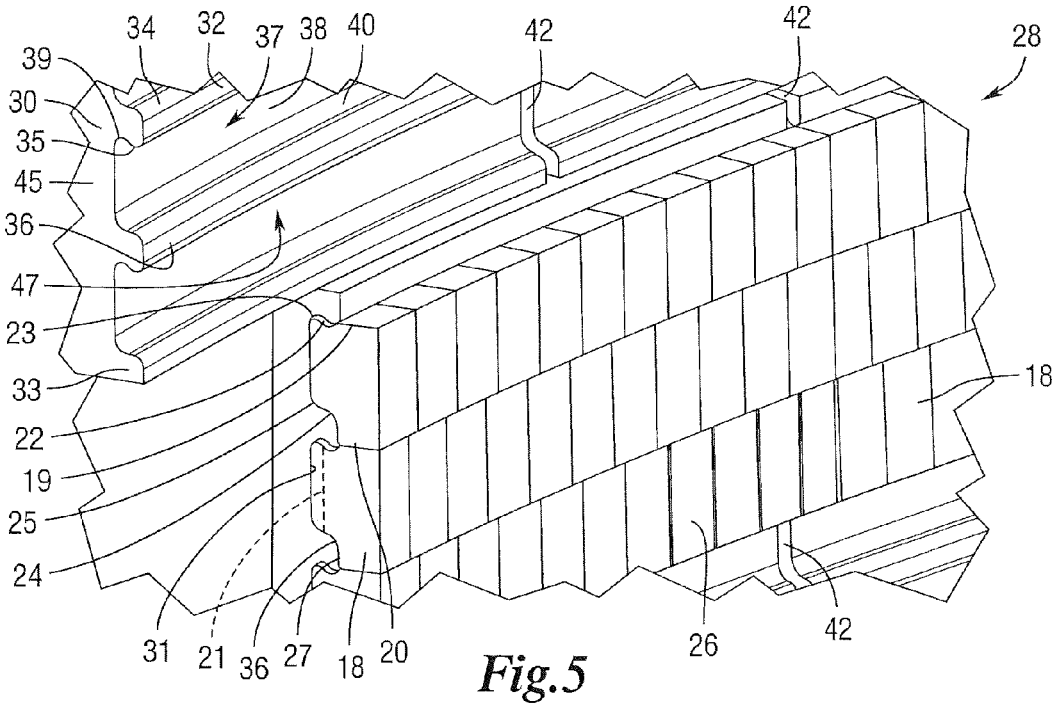
FIG. 5 is a side perspective view of a preferred embodiment of a furnace lining of the present invention comprising a preferred embodiment of a stave/brick construction of the present invention employing the brick of FIG. 3.
Figure 6:
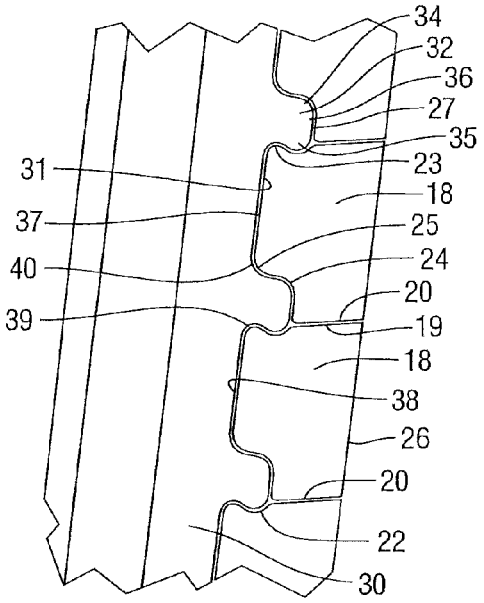
FIG. 6 is a cross-sectional view of a preferred embodiment of a stave/brick construction of the present invention employing the brick of FIG. 3.
Figure 7:
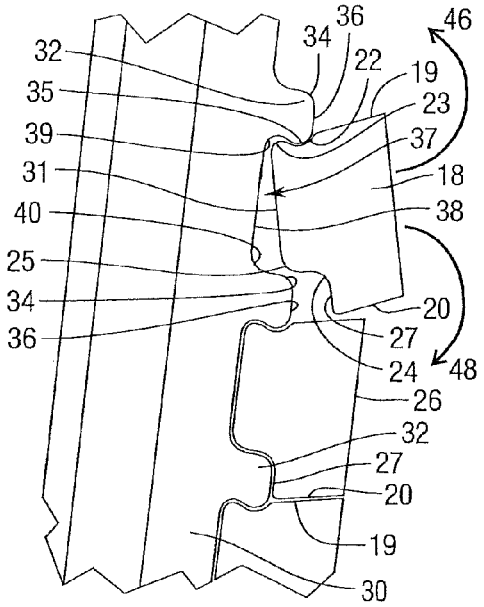
FIG. 7 is a cross-sectional view of a preferred embodiment of a stave/brick construction of the present invention showing the brick of FIG. 3 as it is being inserted or removed from a front face of a preferred embodiment of a stave of the present invention.

As shown in FIGS. 6 and 7, while the stave bricks 18 of the present invention may be slid into stave channels 37 from the sides 45 of stave 30 when space permits, stave bricks 18 may also preferably and advantageously be inserted into the front face 47 of staves 30. Beginning at the bottom of stave 30, each stave channel 37 may be filled with stave bricks 18 by rotating or tilting each brick 18 in a first direction 46 where the bottom portion of brick 18 stave or (2) to allow nose 23 to be inserted into stave channel 37 and into concave, arcuate upper channel section 39, after which brick 18 is rotated in a second direction 48 generally such that the bottom of brick 18 moves toward stave 30 until (i) nose 23 is disposed in-whole or in-part within concave, arcuate upper channel section 39 with or without the perimeter of nose 23 being in partial or complete contact with upper channel section 39, (ii) front face 31 of brick 18 is disposed substantially near and/or adjacent to channel wall 38 with or without the front face 31 being in partial or complete contact with channel wall 38, (iii) arcuate seat 25 is disposed in-whole or in-part within arcuate lower channel section 40 with or without the perimeter of seat 25 being in partial or complete contact with lower channel section 40, (iv) arcuate concave section 24 is disposed in-whole or in-part over the arcuate top rib section 34 of the lower stave rib 32 of the successive pair of stave ribs 32 defining the stave channel 37 into which the brick 18 is being inserted with or without the inside surface of concave section 24 being in partial or complete contact with the arcuate top rib section 34 of such lower stave rib 32, (v) lower face 27 of brick 18 is disposed substantially near and/or adjacent to rib face 36 with or without the lower face 27 being in partial or complete contact with rib face 36, and/or (vi) slanted bottom section 20 of the brick 18 being installed is disposed substantially near and/or adjacent to slanted top section 19 of the brick 18 immediately below the brick 18 being installed with or without such slanted bottom section 20 being in partial or complete contact with such slanted top section 19, in the case where the brick 18 is being installed in any of the stave channels 37 except the lowest stave channel 37 of stave 30. As illustrated in FIGS. 5-7, when the nose 23 is disposed in-whole or in-part within concave, arcuate upper channel section 39 with or without the perimeter of nose 23 being in partial or complete contact with concave, upper channel section 39, and/or arcuate seat 25 is disposed in-whole or in-part within concave, arcuate lower channel section 40 with or without the perimeter of seat 25 being in partial or complete contact with concave, lower channel section 40, each of the bricks 18 is prevented from being moved linearly out of stave channel 37 through the opening in the front face 47 of stave 30 without each brick 18 being rotated such that the bottom thereof is rotated away from the front face 47 of stave 30.

As also shown in FIGS. 5-8, once a row of bricks 18 is installed in a stave channel 37 above a row of previously installed bricks 18, the bricks 18 in such immediately lower row are locked into place and cannot be rotated in the first direction 46 away from stave 30 to be removed from stave channel 37. The stave/refractory brick construction 28 of the present invention as shown in FIGS. 3-7 and 10 may be employed with or without mortar between adjacent stave bricks 18.

Figure 8:
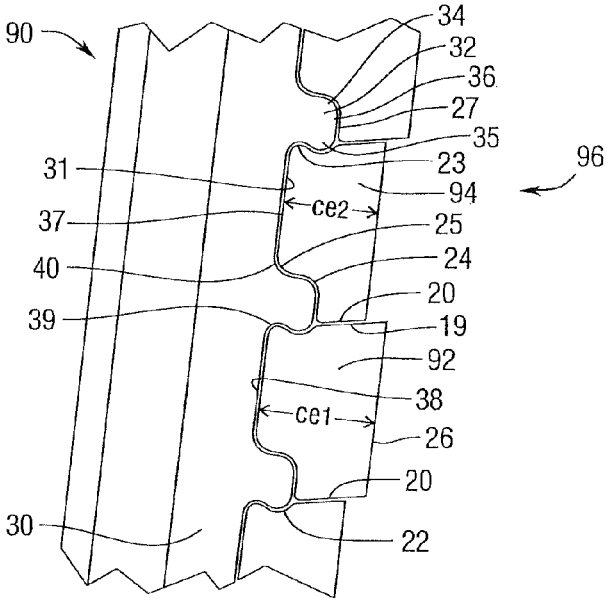
FIG. 8 is a cross-sectional view of a preferred embodiment of an alternative stave/brick construction of the present invention employing at least two different sizes of the bricks of FIG. 3.

FIG. 8 illustrates another preferred embodiment of a stave/brick construction 90 of the present invention which is the same as stave/brick construction 28 of FIGS. 4-7 except that it employs at least two different sizes of stave bricks 92 and 94, respectively, to form an uneven front face 96. As shown, bricks 92 of the stave/brick construction 90 have a greater overall depth "ce1" than the depth "ce2" of bricks 94. This staggered construction resulting from the different depths of stave bricks 92 and 94, respectively, may preferably be used in accretion zones or other desirable zones of the furnace where the uneven front face 96 would be more effective at holding an accretion or buildup of material to further protect the bricks 92 and 94 from thermal and/or mechanical damage.

Figure 9:
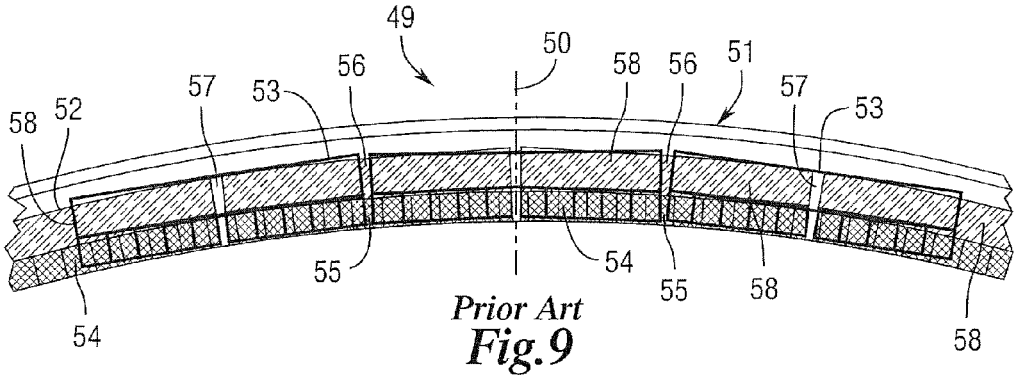
Prior Art Fig.9
FIG. 9 is a top plan view of a conventional furnace lining employing conventional stave/brick constructions.
Figure 10:
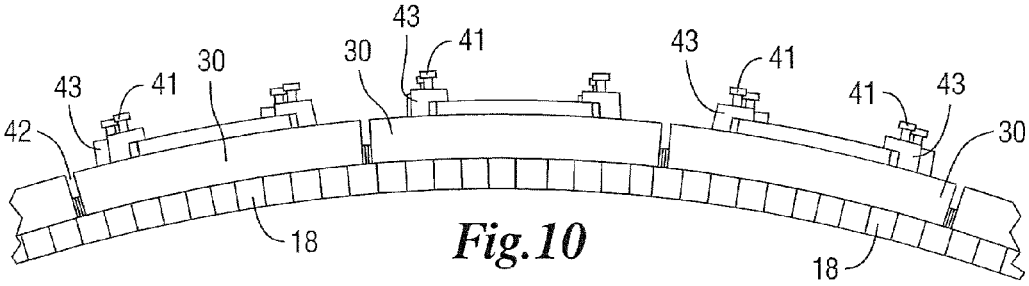
FIG. 10 is a top plan view of a preferred embodiment of a furnace lining of the present invention comprising a preferred embodiment of a stave/brick construction of the present invention employing the brick of FIG. 3.

FIG. 9 illustrates the use of conventional stave/brick constructions 58 within a furnace 49. When using flat or curved staves/coolers, such as the flat/planar upper and lower staves 52 and 53, respectively, with pre-installed bricks 54 arranged within furnace shell 51, such staves 52 and 53 are installed in the furnace 49 such that ram gaps 56 exist in between adjacent pairs of upper staves 52 and such that ram gaps 57 exist in between adjacent pairs of lower staves 53, both to allow for construction allowance. These ram gaps 56 and 57 must be used to allow for construction deviation. Such ram gaps 56 and 57 are typically rammed with refractory material (not shown) to close such gaps 56 and 57 between the adjacent stave/brick constructions 58. Such material filled gaps 56 and 57 typically are weak points in such conventional furnace linings using stave/brick constructions 58. During operation of furnace 49, the rammed gaps 56 and 57 erode prematurely and furnace gases track between the stave/brick constructions 58. With the preferably curved stave/brick constructions 28 of the present invention, the furnace can be bricked continuously around its circumference to eliminate conventional rammed gaps with bricks 18. As shown in FIG. 10, the gaps 42 between staves 30 are covered by one or more of bricks 18 of the present invention, eliminating the need for ramming filling material into such gaps 42. By eliminating the conventional rammed gaps 56 and 57 between the furnace bricks of adjacent staves 30, the integrity and life of the furnace and/or furnace lining is increased.

Another problem associated with the conventional stave/brick constructions 58 having pre-installed bricks 54, as shown in FIG. 9, is that because such conventional stave/brick constructions 58 are not continuously bricked around the circumference of furnace 49, edges 55 of numerous of the bricks 54 protrude into the interior of furnace 49 and are thus exposed to any matter falling through the furnace 49. Such protruding edges 55 tend to wear faster and/or are susceptible to being hit by falling matter, causing such bricks 54 with protruding edges 55 to break off into the furnace 49 and expose the staves 52 and 53. Again, the stave/brick constructions 28 of the present invention allow the furnace to be bricked continuously around its circumference thereby eliminating any such protruding brick edges 55, as shown in FIG. 10. Thus, the occurrences of (i) bricks 18 being pulled or knocked out of staves 30 and (ii) of staves 30 being directly exposed to the intense heat of the furnace are both significantly reduced by the stave/brick construction 28 of the present invention. Such characteristics make the stave/brick construction 28 of the present invention well-suited for use in the stack of blast furnaces.

As also shown in FIG. 10, a plurality of pin mounting cylinders 43 are preferably formed on the back side of each stave 30 for mounting pins 41 used to handle each stave 30, and/or to secure and/or mount each stave 30 within a furnace. Each of the pins 41 preferably defines a threaded or unthreaded thermocouple mounting hole (not shown) allowing one or more thermocouples to be easily installed at various locations on each stave 30.

While the preferred embodiment of a stave/refractory brick construction 28 of the present invention shown in FIGS. 3-8 and 10, includes a preferred embodiment of a furnace cooler or stave 30, the teachings of the present invention are also applicable to a frame/brick construction where such frame (not shown) is not limited to a furnace cooler or stave 30, but is a frame for providing a standing or other supported vertical or slanted wall of bricks, whether or not refractory bricks, for applications including, but not limited to, furnace applications.

Figure 11:
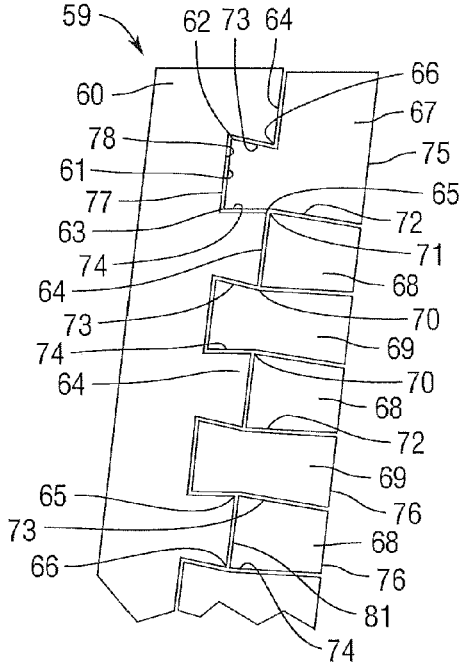
FIG. 11 is a cross-sectional view of another preferred embodiment of a stave/brick construction of the present invention.
Figure 12:
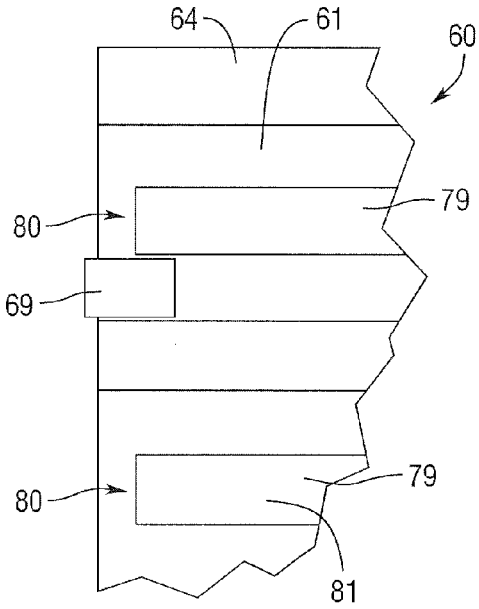
FIG. 12 is a partial, front elevational view of the stave/brick construction of FIG. 11.

FIGS. 11-12 illustrate another preferred embodiment of a stave/brick construction 59 of the present invention comprising stave 60 and alternating shallow and deep dovetail bricks 68 and 69, respectively, including top line stave brick 67 which preferably has the same depth as a long brick 69 and an exposed face 75 of greater height than the exposed faces 76 of the other shallow and deep dovetail bricks 68 and 69. As shown, both shallow and deep dovetail bricks 68 and 69 have upper and lower dovetail or oblique sections 73 and 74, respectively. Further, each of the bricks 67, 68 and 69 defines two brick corners 71 while deep bricks 69 define two concave brick vertexes 70 that match up with the brick corners 71 of shallow bricks 68 upon completion of the stave/brick construction 59 of the present invention. Stave 60 preferably comprises a plurality of stave ribs 64 and a stave socle (not shown) to support stave 60 in a standing position which may be a fully upright 90 degrees, or a tilted or slanted position. Each stave rib 64 preferably defines generally angular upper and lower rib edges 65 and 66, respectively. Stave 60 preferably defines a plurality stave channels 61 between each successive pair of stave ribs 64. Preferably, each stave channel 61 comprises a generally planar stave channel wall 77, although stave channel wall 77 may also be curved or contoured along its vertical and/or horizontal axes, toothed, etc., to be complementary with the front faces 78 of the deep dovetail bricks 69 if such front face 78 has a shape other than the planar shape depicted herein, which may depend upon the application. Each stave channel 61 also preferably includes a generally dovetail-shaped upper channel section 62 and a generally dovetail-shaped lower channel section 63, all as defined by stave 60 and a successive pair of stave ribs 64. The shapes, geometries and/or cross-sections of one or more of the stave ribs 64, upper and lower rib edges 65 and 66, stave channels 61, stave channel walls 77, upper channel sections 62, lower channel sections 63, brick vertexes 70 and brick edges 71, upper and lower dovetail sections 73 and 74, exposed faces 75 and 76 and front faces 78 preferably may be modified or take other forms such as being contoured, angular, rectilinear, polygonal, geared, toothed, symmetrical, asymmetrical or irregular instead the shapes of the preferred embodiments thereof as shown in the drawings hereof with out departing from the scope of the present invention.

The view of stave/brick construction 59 of the present invention in FIG. 12 shows that every other one 79 of stave ribs 64 is preferably shortened by less than half the thickness (i.e., width) of bricks 67, 68 and 69, that is by: ((brick thickness−designed gap length between the staves or coolers)/2)+ ¼" for construction deviation. An additional brick (not shown), preferably of higher thermal conductivity to promote cooling similar to that of the stave/cooler 60, would be installed in place of the missing section of stave rib 64 to fill the void 80. Such stave/brick construction 59 allows the bricks 67, 68 and 69 to be inserted into and/or removed from stave channels 61, after stave 60 has been installed in the furnace, by sliding such bricks into stave channels 61 via voids 80, i.e., the extra room created by shortened stave ribs 79.

The stave/brick construction 59 may preferably employ a single brick design (not shown) or the alternating shallow and deep bricks 68 and 69, respectively, as shown in FIG. 11 wherein the dovetail sections 73 and 74 of deep bricks 69 are inserted and received into stave channels 61, each of the front faces 78 of shallow bricks 68 is disposed substantially near and/or adjacent to a respective face 81 of a stave rib 64 with or without such front face 78 being in partial or complete contact with its respective rib face 81, and each of the brick edges 71 of shallow bricks 68 is disposed substantially near and/or adjacent to a respective vertex 70 of a deep brick 69 with or without such brick edge 71 being in partial or complete contact with its respective vertex 70 of a deep brick 69. Additionally, other stave/brick constructions employing bricks of two or more different shapes with a portion of all such bricks being received in a stave channel is within the scope of the present invention.

The stave/brick constructions of the present invention preferably also may be assembled initially by setting the bricks in a form and casting the stave around the bricks.

In the foregoing Detailed Description, various features are grouped together in a single embodiment to streamline the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A stave/brick construction, comprising:

a stave having a plurality of ribs and a plurality of channels, wherein a front face of the stave defines a first opening into each of the channels; and a plurality of bricks wherein each brick is insertable into one of the plurality of channels via its first opening to a position, upon rotation of the brick, partially disposed in the one channel such that one or more portions of the brick at least partially engage one or more surfaces of the one channel and/or of a first rib of the plurality of ribs whereby the brick is locked against removal from the one channel through its first opening via linear movement without first being rotated.

2. The stave/brick construction of claim 1 wherein the stave defines one or more side openings into each of the channels.

3. The stave/brick construction of claim 1 wherein said one or more portions of the brick comprises a nose at least partially disposed in a first section of the one channel.

4. The stave/brick construction of claim 3 wherein the first section is complementary to the nose.

5. The stave/brick construction of claim 1 wherein the rotation of the brick comprises a bottom of the brick moving in a direction towards the stave.

6. The stave/brick construction of claim 1 wherein a first rib surface of the first rib is complementary to a groove defined by a top of the brick and wherein the first rib surface is at least partially disposed in the groove.

7. The stave/brick construction of claim 1 wherein each of the plurality of bricks can be removed from its respective channel via rotation of each brick comprising a bottom of each brick moving in a direction away from the stave.

8. The stave/brick construction of claim 1 wherein the stave is substantially flat.

9. The stave/brick construction of claim 1 wherein the stave is curved with respect to one or both of a horizontal axis and a vertical axis.

10. The stave/brick construction of claim 1 wherein the stave houses a plurality of pipes.

11. The stave/brick construction of claim 1 wherein the plurality of bricks at least partially disposed in the plurality of channels form a plurality of stacked, substantially horizontal rows of bricks protruding from the front face of the stave.

12. The stave/brick construction of claim 11 wherein one of the bricks cannot be pulled and/or rotated out of the first opening of its respective channel when another brick is disposed in the row above and partially or completely covers the one brick.

13. The stave/brick construction of claim 1 comprising a plurality of staves standing side-by-side with gaps between adjacent staves;

wherein each stave has a plurality of ribs, a plurality of channels, and a plurality of substantially horizontal rows of bricks disposed in the plurality of channels.

14. The stave/brick construction of claim 13 wherein the plurality of substantially horizontal rows of bricks disposed in the plurality of channels covers, in-whole or in-part, the gaps between adjacent staves.

15. The stave/brick construction of claim 13 wherein the staves stand substantially vertically or at an angle other than about 90 degrees.

16. The stave/brick construction of claim 1 wherein each of the plurality of bricks further defines a seat wherein the seat is at least partially disposed in a second section of the one channel.

17. The stave/brick construction of claim 16 wherein the second section is complementary to the seat.

18. The stave/brick construction of claim 1 wherein each of the plurality of bricks comprises an oblique top section and an oblique bottom section, wherein each of the oblique top and bottom sections protrude from the face of the stave.

19. The stave/brick construction of claim 18 wherein the oblique top and bottom sections are substantially parallel.

20. The stave/brick construction of claim 18 wherein the plurality of bricks at least partially disposed in the plurality of channels form a plurality of stacked, substantially horizontal rows of bricks protruding from the front face of the stave; and wherein the oblique top section of one brick is disposed substantially near, adjacent to, in partial contact with or in complete contact with the oblique bottom section of another brick immediately above the one brick.

21. The stave/brick construction of claim 1 further comprising means for operatively connecting a thermocouple to the stave.

22. The stave/brick construction of claim 11 wherein the plurality of bricks comprise exposed faces that define a flat or uneven surface.

23. A frame/brick construction, comprising:

a frame having a plurality of ribs and a plurality of channels, wherein a front face of the frame defines a first opening into each of the channels; and a plurality of bricks wherein each brick is insertable into one of the plurality of channels via its first opening to a position, upon rotation of the brick, partially disposed in the one channel such that one or more portions of the brick at least partially engage one or more surfaces of the one channel and/or of a first rib of the plurality of ribs whereby the brick is locked against removal from the one channel through its first opening via linear movement without first being rotated.

24. The frame/brick construction of claim 23 wherein the frame defines one or more side openings into each of the channels.

25. The frame/brick construction of claim 23 wherein said one or more portions comprises a nose at least partially disposed in a first section of the one channel.

26. The frame/brick construction of claim 25 wherein the first section is complementary to the nose.

27. The frame/brick construction of claim 23 wherein the rotation of the brick comprises a bottom of the brick moving in a direction towards the frame.

28. The frame/brick construction of claim 23 wherein a first rib surface of the first rib is complementary to a groove defined by a top of the brick and wherein the first rib surface is at least partially disposed in the groove.

29. The frame/brick construction of claim 23 wherein each of the plurality of bricks can be removed from its respective channel via rotation of each brick comprising a bottom of each brick moving in a direction away from the frame.

30. The frame/brick construction of claim 23 wherein the frame is substantially flat.

31. The frame/brick construction of claim 23 wherein the frame is curved with respect to one or both of a horizontal axis and a vertical axis.

32. The frame/brick construction of claim 23 wherein the plurality of bricks at least partially disposed in the plurality of channels form a plurality of stacked, substantially horizontal rows of bricks protruding from the front face of the frame.

33. The frame/brick construction of claim 32 wherein one of the bricks cannot be pulled and/or rotated out of the first opening of its respective channel when another brick is disposed in the row above and partially or completely covers the one brick.

34. The frame/brick construction of claim 23 comprising a plurality of frames standing side-by-side with gaps between adjacent frames;

wherein each frame has a plurality of ribs, a plurality of channels, and a plurality of substantially horizontal rows of bricks disposed in the plurality of channels.

35. The frame/brick construction of claim 34 wherein the plurality of substantially horizontal rows of bricks disposed in the plurality of channels covers, in-whole or in-part, the gaps between adjacent frames.

36. The frame/brick construction of claim 34 wherein the frames stand substantially vertically or at an angle other than about 90 degrees.

37. The frame/brick construction of claim 23 wherein each of the plurality of bricks further defines a seat wherein the seat is at least partially disposed in a second section of the one channel.

38. The frame/brick construction of claim 37 wherein the second section is complementary to the seat.

39. The frame/brick construction of claim 23 wherein each of the plurality of bricks comprises an oblique top section and an oblique bottom section, wherein each of the oblique top and bottom sections protrude from the face of the frame.

40. The frame/brick construction of claim 39 wherein the oblique top and bottom sections are substantially parallel.

41. The frame/brick construction of claim 39 wherein the plurality of bricks at least partially disposed in the plurality of channels form a plurality of stacked, substantially horizontal rows of bricks protruding from the front face of the frame; and wherein the oblique top section of one brick is disposed substantially near, adjacent to, in partial contact with or in complete contact with the oblique bottom section of another brick immediately above the one brick.

42. The frame/brick construction of claim 32 wherein the plurality of bricks comprise exposed faces that define a flat or uneven surface.

43. A method for assembling a stave/brick construction comprising:

providing a stave in a standing position, wherein the stave has a plurality of ribs and a plurality of channels, and wherein a front face of the stave defines a first opening into each of the channels;

inserting a plurality of bricks into each channel via its first opening so that a first portion of each brick enters its respective channel via its first opening; and rotating each brick so that it is partially disposed in its respective channel with its first portion at least partially engaged with one or more surfaces of its respective channel and/or of a first rib of the plurality of stave ribs whereby the brick is locked against removal from the one channel through its first opening via linear movement without first being rotated.

44. The method for assembling a stave/brick construction of claim 43 wherein after inserting, the first portion of each brick is at least partially disposed in a first section of its respective channel.

45. The method for assembling a stave/brick construction of claim 43 wherein the rotating of each brick comprises a bottom of the brick moving in a direction towards the stave.

46. The method for assembling a stave/brick construction of claim 43 further comprising:

removing one or more of the plurality of bricks from their respective channels via rotation of the one or more bricks comprising a bottom of each brick moving in a direction away from the stave.

47. A brick for a stave/brick construction, comprising:

a top section defining a nose contiguous with a locking side of the brick and an upper oblique section contiguous with a first face of the brick, wherein the locking side comprises the nose, a second face, a seat and a lower concave section; and a bottom defining a lower oblique section contiguous with the first face of the brick.

48. The brick for a stave/brick construction of claim 47, further comprising:

a groove defined by the top section disposed across a width of the brick.

49. The brick for a stave/brick construction of claim 47, wherein the second face extends from the nose to the seat and is opposite to the first face.

50. The brick for a stave/brick construction of claim 48, wherein a height of the second face is equal to or greater than about two times a depth of the brick measured from the second face to a bottom of the groove.

51. The brick for a stave/brick construction of claim 47, wherein one or both of the nose and seat are arcuate.

52. The brick for a stave/brick construction of claim 47, wherein one or both the nose and seat are polygonal.

53. The brick for a stave/brick construction of claim 47, wherein one or both the nose and seat are angular.

54. The brick for a stave/brick construction of claim 47, wherein one or both of the first and second faces are substantially flat.

55. A stave/brick construction, comprising:

a stave having a plurality of ribs and a plurality of channels, wherein a front face of the stave defines a first opening into each of the channels and wherein the plurality of ribs comprises one or more short ribs each of which is shorter than one or more adjacent long ribs, wherein each short rib and at least one adjacent long rib define, at least in part, a void such that the stave defines a plurality of voids; and a plurality of bricks wherein each brick is insertable into one of the plurality of voids in a direction substantially perpendicular to the front face to a first position from which it can be slid to a second position within one of the plurality of channels.

* * * * *